US006124779A

United States Patent [19]

Yamamoto

[11] Patent Number: 6,124,779

[45] Date of Patent: Sep. 26, 2000

[54] MULTILAYER-TYPE INDUCTOR

[75] Inventor: Shigekatsu Yamamoto, Takefu, Japan

[73] Assignee: Murata Manufacturing Co. Ltd., Nagaokakyo, Japan

[21] Appl. No.: 08/988,241

[22] Filed: Dec. 10, 1997

[30] Foreign Application Priority Data

Dec. 11, 1996 [JP] Japan ..... 8-331182

[51] Int. Cl.[7] ..... H01F 5/00; H01F 27/28

[52] U.S. Cl. ..... 336/200; 336/223; 336/232; 29/604

[58] Field of Search ..... 336/200, 232, 336/223; 29/604, 607

[56] References Cited

U.S. PATENT DOCUMENTS 3,812,442 5/1974 Muckelroy ..... 336/83
5,153,859 10/1992 Chatigny et al. ..... 367/140
5,392,019 2/1995 Ohkubo ..... 336/200

FOREIGN PATENT DOCUMENTS 55-091103 7/1980 Japan ..... 336/200

*Primary Examiner*—Michael L. Gellner
*Assistant Examiner*—Anh Mai
*Attorney, Agent, or Firm*—Burns, Doane, Swecker & Mathis, LLP

[57] ABSTRACT

A multilayer-type inductor manufacturing method is provided which is capable of easily obtaining inductors having many different inductance values even if the pattern of a coil conductor is not changed for each inductance value. The coil conductor includes a line section of a predetermined pattern, a viahole connected at the end of the line section, and a pad. The viahole and the pad have a width greater than that of the line section and have an elongated shape. By deviating adjacent coil conductors in the direction of the length of the viahole and the pad, the inner area of a coil formed of the coil conductors is increased or decreased, thus varying the inductance value of an inductor.

18 Claims, 4 Drawing Sheets

MULTILAYER-TYPE INDUCTOR

BACKGROUND OF THE INVENTION

1. Field of the Invention

The present invention relates to a method of manufacturing multilayer-type inductor and, more particularly, to multilayer-type inductors having small tolerances for inductance values while retaining the ability to provide many different inductance values using one set of component parts, and to said multilayer inductor.

2. Description of the Related Art

Conventional multilayer-type inductors are disclosed in Japanese Examined Patent Publication No. 57-39521, and in Japanese Unexamined Utility Model Publication No. 57-100209. The inductor of the former publication is manufactured in the following way. A first coil conductor annularly extending about 90°, i.e., for about a quarter turn, is formed on a thin plate of magnetic material, and a layer of magnetic material is formed on this first coil conductor. Thereafter, a second coil conductor extending for about a quarter turn is formed on the magnetic layer so that one end of the second coil conductor is connected to the first coil conductor. Next, another magnetic layer is formed on the second coil conductor with the other end of the second coil conductor being exposed and, subsequently, the same process is predetermined number of times so that the quarter turn coil conductors are stacked in layers in the direction of multilayer, i.e., normal to the plane of the thin plate.

The inductor as disclosed in the later publication is manufactured in the following way. A hole is provided in a part of a magnetic sheet. One end of a U-shaped coil conductor is positioned at this hole so that a part of the coil conductor is exposed at the rear surface of the sheet through the hole. By stacking these sheets so that the open end of U-shaped coil conductors face each other but in different planes, the coil conductors of each sheet are connected to each other to form a coil structure.

Generally, if the inductance value of the inductor is denoted as L, the specific magnetic permeability of a material used for an insulating layer as $\mu_s$, the inner area of a coil as S, and the length of the coil as l, the following equation (1) is satisfied:

$$L=\mu_s\mu_o kS/l \quad (1)$$

where k is a constant proportional to the square of the number of windings of the coil, and $\mu_o$ is the magnetic permeability of the material used for the insulating layer.

Therefore, in both inductors described above, in order to obtain many different inductance values, the number of windings of the coil, the diameter of the coil (i.e., the inner area of the coil), the specific magnetic permeability of the material used for the insulating layer, and the thickness of the insulating layer may be appropriately set. However, in order to set a very small inductance value, changing the specific magnetic permeability, the thickness of the insulating layer, and the number of windings of the coil is not suitable, and normally, a predetermined inductance value is obtained by adjusting the diameter of the coil by varying the pattern of the coil conductor.

In this case, it is necessary to prepare a pattern of the coil conductor for each inductance value. The manufacturing cost of the pattern and the cost for changing the stage for the pattern during manufacturing are large, hindering a reduction in the product price. As a countermeasure to this, a method has been proposed in which the inductance value is adjusted by replacing some layers of coil conductors to be stacked with coil conductors having a smaller diameter. However, this method is used only in some inductors because the management of the multilayering process becomes complex and the frequency characteristic deteriorates due to the disturbances of the magnetic flux.

SUMMARY OF THE INVENTION

Accordingly, an object of the present invention is to provide a multilayer-type inductor capable of easily obtaining many different inductance values without necessarily changing the pattern of the coil conductor for each inductance value.

To achieve the above objects, according to the present invention, there is provided a method of manufacturing a multilayer-type inductor, comprising the steps of: providing a plurality of insulating layers; providing a plurality of coil conductors; alternately layering the insulating layers and the coil conductors to form a multilayered stack, wherein one end of at least one coil conductor overlays and electrically connects with one end of an adjacent coil conductor, and wherein said plurality of coil conductors are electrically connected to form a coil; and selectively adjusting the degree of overlap of the at least one coil conductor and the adjacent coil conductor.

Also provided is a multilayer-type inductor, wherein the plurality of coil conductors, each of which has a line section and a connection section, with the width of a predetermined connection section made greater than that of the line section, are electrically connected in series via the connection section in order to form a coil, and further, in order to change the inner area of the coil, the coil conductors having a wide connection section are disposed in such a manner that they can be shifted in position by a predetermined amount in the direction of the length of the connection section such that the degree of overlap is changed.

With the above-described construction, since the diameter of the coil, namely, the inner area of the coil, increases or decreases according to the amount of deviation in the position of the coil conductors, by appropriately setting the amount of deviation in position of the coil conductors many different inductance values can be easily obtained. Therefore, it is not necessary to change the pattern of the coil conductor for each inductance value.

The above and further objects, aspects and novel features of the invention will become more apparent from the following detailed description when read in connection with the accompanying drawings.

DESCRIPTION OF THE PREFERRED EMBODIMENTS

The preferred embodiments of a multilayer-type inductor according to the present invention will be described below with reference to the accompanying drawings.

Figure 1:
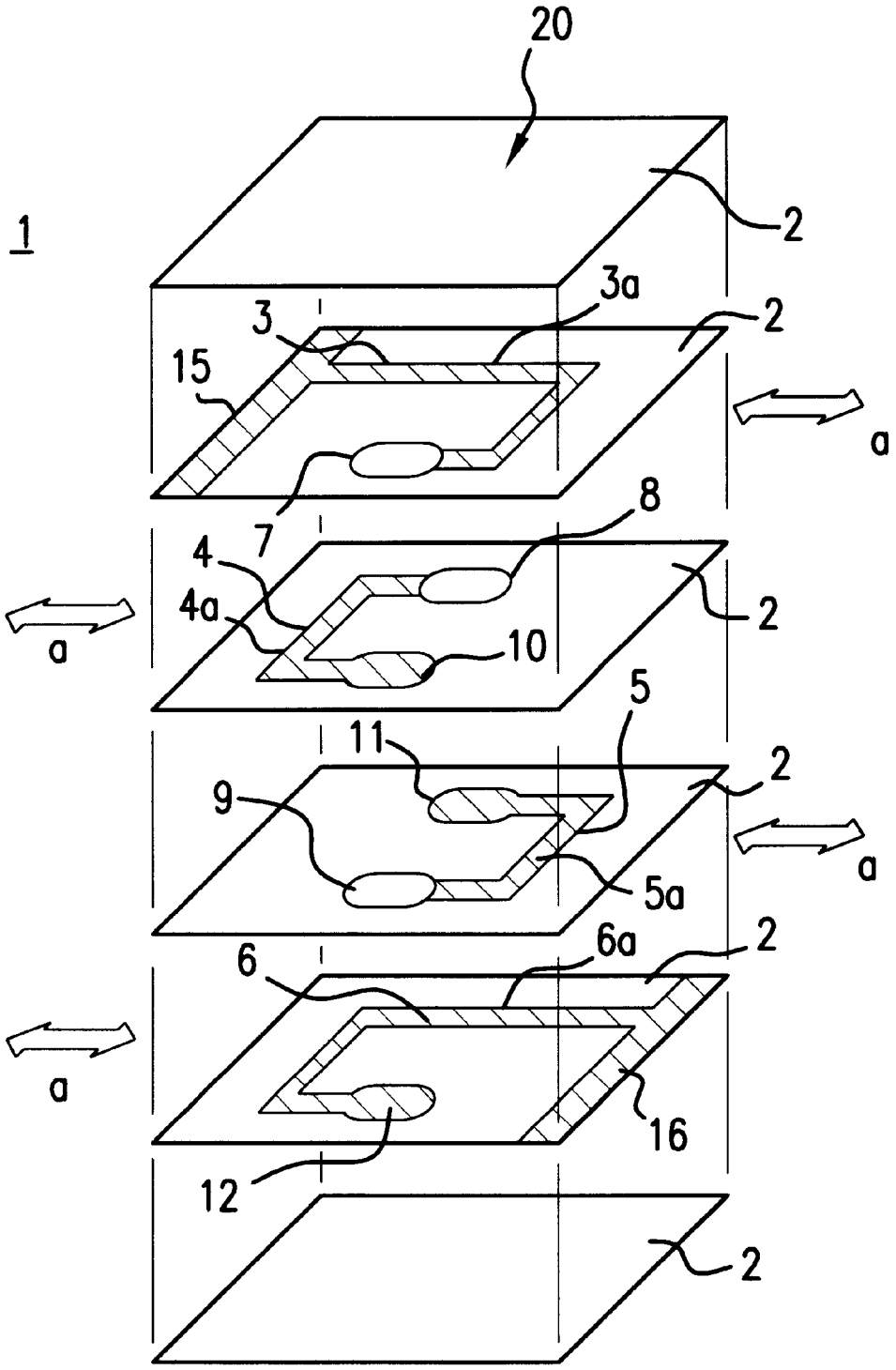
FIG. 1 is an exploded perspective view illustrating a first embodiment of a multilayer-type inductor according to the present invention.
Figure 2A:
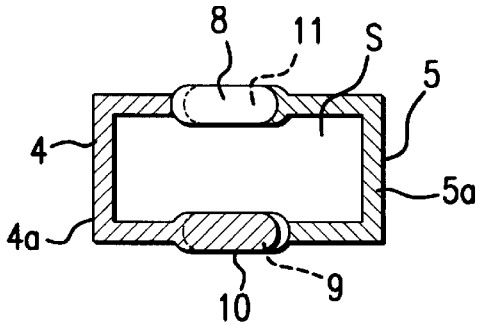
FIGS. 2A, 2B, and 2C are sight-through plan views illustrating states in which the coil conductors are deviated from each other.
Figure 2B:
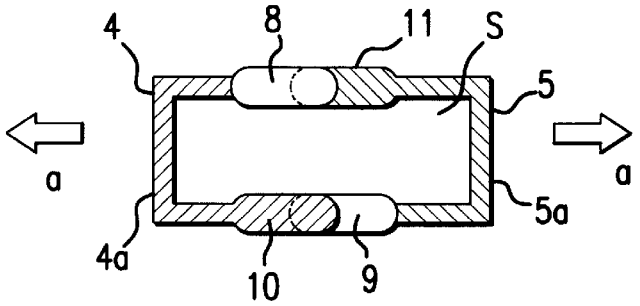
Figure 2C:
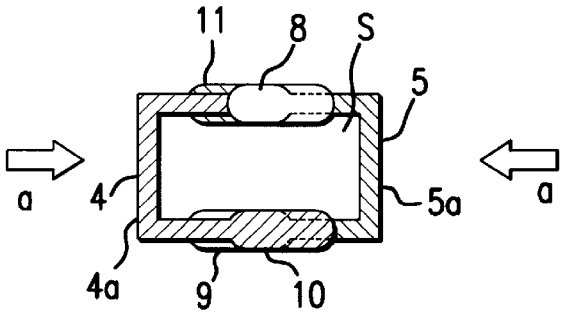
Figure 3:
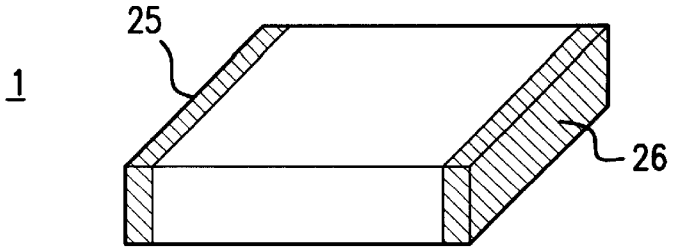
FIG. 3 is a perspective view illustrating the exterior of the multilayer-type inductor shown in FIG. 1.

[First Embodiment, FIGS. 1 to 3]

As shown in FIG. 1, a multilayer-type inductor 1 is formed of insulation sheets 2 which are provided with coil conductors 3, 4, 5, and 6, respectively, an additional insulation sheet 2 serving as an outer layer, and the like. The insulation sheets 2 are individually formed into a sheet after mixing a dielectric powder or a magnetic powder together with a binding agent. The coil conductors 3 to 6 have line sections 3*a* to 6*a* of a predetermined pattern, viaholes 7, 8, and 9 which are connected to the ends of the line sections 3*a* to 6*a*, and connecting portions of the lines or pads 10, 11, and 12, respectively. Herein, it should be understood that the viaholes are filled with an electrically conductive material. The other end of the first coil conductor 3 (not connected to the viahole 7) is electrically connected to an extraction or external electrode 15 provided on the left side of the sheet 2 as shown in the illustrated exemplary embodiment, and the other end of the last coil conductor 6 is electrically connected to an extraction or external electrode 16 provided on the right side of the sheet 2 as illustrated.

The widths of the viaholes 7 to 9, and the pads 10 to 12 are greater than those of the line sections 3*a* to 6*a* and have an elongated shape. In the case of the first embodiment, an oval shape is used for the viaholes 7 to 9 and the pads 10 to 12. The viaholes 7 to 9 and pads 10 to 12 are not limited to this shape, however. Of course, they may be rectilinear or virtually any other shape. The coil conductors 3 to 6 and the extraction electrodes 15 and 16 are made of Ag, Pd, Ag—Pd, Cu, or the like, and are formed on the surface of the sheet 2 by any of several known material disposition methods, such as a printing method, a sputtering method, or a vacuum evaporation method.

The coil conductors 3 to 6 are electrically connected in series to form a coil 20 as a result of the viaholes 7, 8 and 9. For example, a line section 3*a* of the coil conductor 3 is electrically connected to the pad 10 on the next insulation sheet 2. Each subsequent coil conductor 4 to 6 is similarly connected. Thus, the coil conductor 3, the viahole 7 and the pad 10 are electrically connected to each other, the coil 4, the viahole 8 and the pad 11 being electrically connected to each other, and the viahole 9 and the pad 12 being electrically connected to each other.

Each sheet 2 is stacked with reference to, for example, a positioning mark (not shown) provided on the sheet 2. At this time, when an inductor having an intermediate inductance value is manufactured, the adjacent coil conductors 3 and 4, 4 and 5, and 5 and 6 are mutually disposed so that the viaholes 7 to 9 approximately overlap the respective pads 10 to 12 (see FIG. 2A). When an inductor having a larger inductance value is manufactured, the adjacent coil conductors 3 to 6 are disposed in such a manner as to be mutually deviated by a predetermined amount in the outward direction "a" of the length of the viaholes 7 to 9 and the pads 10 to 12 (see FIG. 2B). When, conversely, an inductor having a smaller inductance value is manufactured, the adjacent coil conductors 3 to 6 are disposed in such a manner as to be mutually deviated by a predetermined amount in the inward direction "a" taken along the length of the viaholes 7 to 9 and the pads 10 to 12 (see FIG. 2C).

That is, by mutually deviating the adjacent coil conductors 3 to 6 in the direction "a" of the length of the viaholes 7 to 9 and the pads 10 to 12, the inner area S of the coil 20 increases or decreases in equation (1) described above, making it possible to vary the inductance value of the inductor 1. Since the viaholes 7 to 9 and the pads 10 to 12 are wide and elongated, even if the coil conductors 3 to 6 are mutually deviated in the direction of the length of the viaholes 7 to 9 and the pads 10 to 12 and to some degree in the direction of their width, the electrical connection between the viaholes 7 to 9 and the pads 10 to 12 is reliable and stable, resulting in a high connection reliability. If required, the sheets 2 may be temporarily fixed by a bonding agent, or the like, so that the position of the stacked sheets 2 does not move in subsequent process.

Each sheet 2 stacked in this way is contact-bonded, then cut into a predetermined size and sintered into one unit, thus being formed into a laminate.

Next, as shown in FIG. 3, external electrodes 25 and 26 are formed at the right and left ends of the laminate, respectively. The extraction electrode 15 is connected to the external electrode 25, and the extraction electrode 16 is connected to the external electrode 26. These external electrodes 25 and 26 are formed by means of sputtering, vacuum evaporation, printing, and the like.

In the inductor 1 constructed as described above, many different inductance values can be obtained easily by appropriately setting the amount of mutual deviation of the coil conductors 3 to 6, because the inner area of the coil 20 increases or decreases according to the amount that the adjacent coil conductors 3 to 6 are deviated in the direction of the length of the viaholes 7 to 9 and the pads 10 to 12. As a result, it is possible to adjust as desired the inner area of the coil by merely forming one set of coil conductor patterns. This makes it possible to greatly reduce the number of coil conductor patterns for obtaining a predetermined inductance value and to reduce the time required to change the coil conductor pattern.

[Second Embodiment, FIGS. 4 to 9]

A multilayer-type inductor of a second embodiment of the present invention is formed into a multilayered structure as a result of multicoating by coating a paste-like insulating material and a paste-like conductive material in sequence and drying them.

Figure 4:
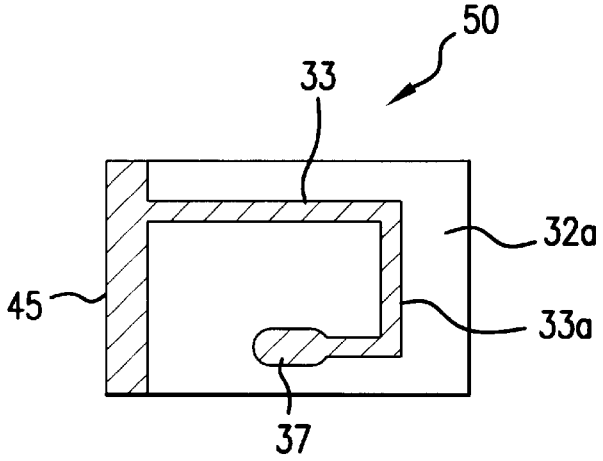
FIG. 4 is a plan view illustrating a second embodiment of a multilayer-type inductor according to the present invention.
Figure 5:
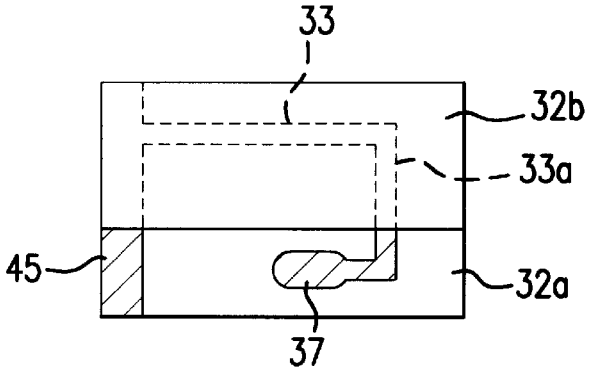
FIG. 5 is a plan view illustrating a manufacturing procedure, continued from FIG. 4.

As shown in FIG. 4, a paste-like insulating material is coated by screen printing and dried to form a rectangular insulating layer 32*a*. Next, a paste-like conductive material is coated on the top surface of the rectangular insulating layer 32*a* by screen printing and dried, and thus a coil conductor 33 and an extraction electrode 45 connected to the coil conductor 33 are formed. The coil conductor 33 has a line section 33*a* and a pad 37 connected to one end of the line section 33*a*. Further, as shown in FIG. 5, a paste-like insulating material is coated and dried to form an insulating layer 32*b* so that the pad 37 is exposed.

Figure 6:
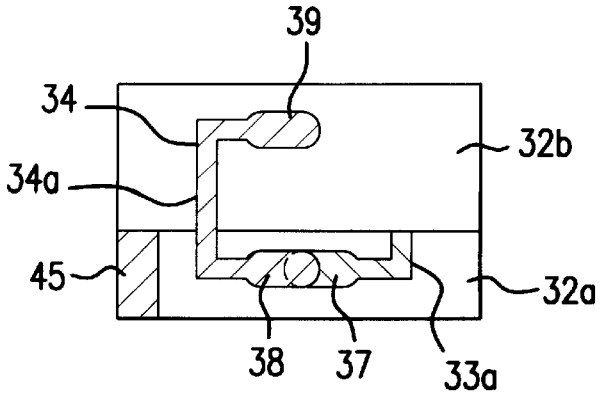
FIG. 6 is a plan view illustrating a manufacturing procedure, continued from FIG. 5.
Figure 7:
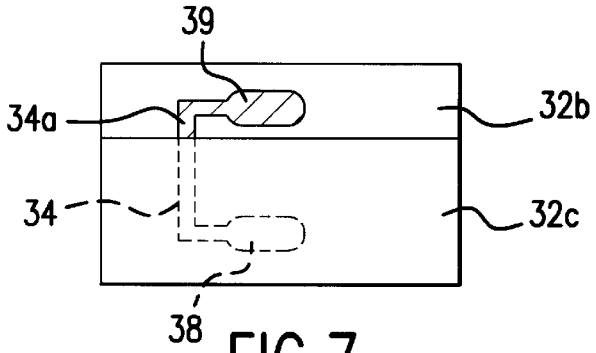
FIG. 7 is a plan view illustrating a manufacturing procedure, continued from FIG. 6.

Next, as shown in FIG. 6, a paste-like conductive material is coated and dried to form a coil conductor 34. The coil conductor 34 has a line section 34*a* and pads 38 and 39 which are respectively connected to the two ends of the line section 34*a*. The pad 38 is electrically connected to the pad 37 of the coil conductor 33. Further, as shown in FIG. 7, a paste-like insulating material is applied and dried, forming an insulating layer 32*c* so that the pad 39 is exposed.

Figure 8:
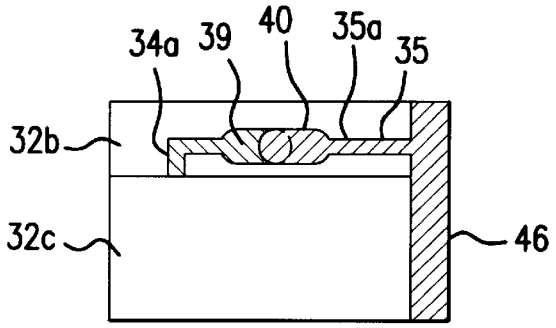
FIG. 8 is a plan view illustrating a manufacturing procedure, continued from FIG. 7.

Next, as shown in FIG. 8, a paste-like conductive material is coated and dried to form a coil conductor 35 and an extraction electrode 46 connected to the coil conductor 35. The coil conductor 35 has a line section 35*a* and a pad 40 connected to one end of the line section 35*a*. The pad 40 is electrically connected to the pad 39 of the coil conductor 34. The coil conductors 33 to 35 are electrically connected in series by the pads 37 to 40, forming a coil 50. Further, by coating a paste-like insulating material on the entire surface and drying, an outer protective insulating layer is formed.

Figure 9:
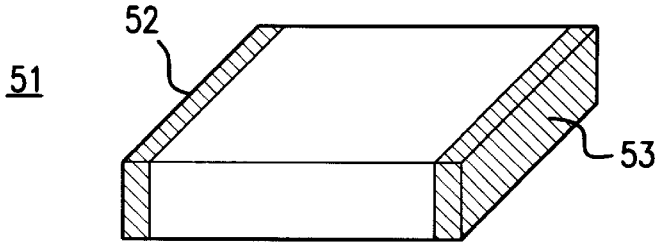
FIG. 9 is a perspective view illustrating the exterior of the multilayer-type inductor of the second embodiment of the present invention.

In this way, the multicoated laminate is cut into a predetermined size and sintered into one unit. Next, as shown in FIG. 9, external electrodes 52 and 53 are formed in the right and left end surfaces of the laminate, respectively. The extraction electrode 45 is connected to the external electrode 52, and the extraction electrode 46 is connected to the external electrode 53.

In the inductor 51 constructed as described above, the ads 37 to 40 are wider than the line sections 33*a* to 35*a* and have an elongated shape. Therefore, even if the respective coil conductors 33 and 35 are mutually deviated in the direction of the length of the pads 37 to 40, the electrical connection between the pads 37 to 40 is reliable and stable, and connection reliability is high. Further, many different inductance values can be obtained easily by appropriately setting the amount of mutual deviation of the coil conductors 33 to 35, because the inner area of the coil 50 increases or decreases according to the amount that the adjacent coil conductors 33 to 35 are mutually deviated in the direction of the length of the pads 37 to 40. As a result, it is possible to adjust as desired the inner area of the coil by merely forming one set of coil conductor patterns. This makes it possible to greatly reduce the number of coil conductor patterns for obtaining a predetermined inductance value and to reduce the time required to change the coil conductor pattern.

[Other Embodiments]

The multilayer-type inductor according to the present invention is not limited to the above-described embodiments, and various modifications are possible within the spirit and scope of the invention.

Figure 10:
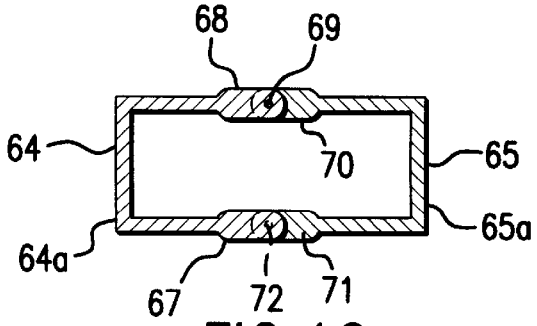
FIG. 10 is a sight-through plan view illustrating another embodiment of the present invention.

Although in the first embodiment sheets are stacked in layers and then sintered into one unit, the present invention is not limited to this, and sheets, which have been previously sintered, may be used. Further, the size of the viaholes of the coil conductor do not always need to be the same size as that of the connection section, and as shown in FIG. 10, viaholes 69 and 72 may be formed in a part of the pads 68 and 71. In FIG. 10, reference numerals 64 and 65 denote coil conductors with project through the insulating layers. Reference numerals 64*a* and 65*a* denote line sections. Reference numerals 67 and 70 denote pads.

Although in each of the above-described embodiments a wide and elongated connection section is formed in all of the coil conductors and all of the coil conductors stacked in layers are deviated, the present invention is not limited to this form, and only a part of each coil conductor may be deviated. Further, a wide and elongated connection section may be formed in only a part of each coil conductor, and all or the parts of the layers having coil connectors with elongated coil connectors may be deviated.

Furthermore, although the above-described embodiments describe a case in which multilayer-type inductors are produced individually, during mass production, mother sheets comprising a plurality of inductors are stacked in layers into a mother substrate, then cut to a predetermined chip size and sintered, and further, external electrodes are formed on both ends of this chip.

As described above, according to the present invention, many different inductance values can be obtained easily according to the amount that coil conductors are deviated by deviating coil conductors having a line section of a predetermined pattern and a connection section with an elongated shape wider than that of the line section by a predetermined amount in the direction of the length of the connection section. Therefore, an inductor having a predetermined inductance value can be obtained by merely forming a limited minimum number of coil conductor patterns.

This makes it possible to greatly reduce the number of coil conductor patterns for obtaining predetermined inductance values and to reduce the time required to change the coil conductor patterns. As a result, it is possible to manufacture a multilayer-type inductor at a lower cost, and to expand the applications for use into an impedance matching circuit.

Many different embodiments of the present invention may be constructed without departing from the spirit and scope of the present invention. It should be understood that the present invention is not limited to the specific embodiments described in this specification. To the contrary, the present invention is intended to cover various modifications and equivalent arrangements included within the spirit and scope of the invention as hereafter claimed. The scope of the following claims is to be accorded the broadest interpretation so as to encompass all such modifications, equivalent structures and functions.

What is claimed is:

1. A method of manufacturing a multilayer inductor, comprising the steps of:

providing a plurality of insulating layers;

providing a plurality of coil conductors;

alternately layering said insulating layers and said coil conductors to form a multilayered stack, wherein one end of at least one coil conductor overlays and electrically connects with one end of an adjacent coil conductor, and wherein said plurality of coil conductors are electrically connected to form a coil; and selectively adjusting a degree of overlap of said at least one coil conductor and said adjacent coil conductor to vary an area circumscribed by the plurality of coil conductors, so as to selectively adjust inductance of the multilayer inductor.

2. The method according to claim 1, further comprising a step of sintering said multilayered stack.

3. The method according to claim 1, wherein said step of providing coil conductors includes for at least one coil conductor forming a line section, a viahole and at least one pad.

4. The method according to claim 3, wherein said step of providing said coil conductors includes forming said viahole and said pad to be elongated in the direction of adjustment in their degree of overlap.

5. The method according to claim 3, wherein said viahole and said pad are the same size and shape.

6. The method according to claim 3, wherein said viahole and said pad are not the same size and shape.

7. The method according to claim 1, wherein said step of providing said insulating layers includes providing insulating sheets formed by mixing together dielectric powder or a magnetic powder with a binding agent and then forming sheets, and wherein said step of providing said coil conductors includes forming said coil conductors on respective sheets by disposition method.

8. The method according to claim 7, wherein said disposition method is selected from the group consisting of sputtering, vacuum evaporation and printing.

9. The method according to claim 7, wherein said sheets are sintered before said layering step.

10. The method according to claim 7, wherein said step of providing said insulating layers includes for at least one layer forming a sheet of paste-like insulating material and drying said sheet, and wherein said step of forming said coil conductors includes selectively coating a paste-like conductive material on said dried insulating sheet and drying said paste-like conductive material.

11. The method according to claim 1, wherein said adjusting step adjusts the degree of overlap of only some of said coil conductors.

12. The method according to claim 1, wherein said adjusting step adjusts the degree of overlap of all of said coil conductors.

13. A multilayer inductor comprising:

a plurality of coil conductors; and a plurality of insulating layers which are stacked on top of each other;

wherein each of said plurality of coil conductors has a line section connecting two wide connection sections, a width of said wide connection sections being greater than that of the line section, said two wide connection sections being parallel to each other;

wherein said coil conductors are electrically connected in series via said wide connection sections, forming a coil, and wherein said wide connection sections of said coil conductors have a long elongated shape extending in a deviation direction of the wide connection sections to permit various degrees of overlap between adjacent and electrically connected wide connection sections which set an inner area circumscribed by the plurality of coil conductors and determine inductance of the multilayer inductor.

14. A multilayer inductor according to claim 13, wherein said coil conductors are made of a paste-like conductive material.

15. A multilayer inductor according to claim 13, wherein said insulating layers are made of a paste-like insulating material.

16. A multilayer inductor according to claim 13, wherein said insulating layers are made of a dielectric powder and a magnetic powder with a binding agent.

17. A multilayer inductor according to claim 13, wherein said coil connectors are U-shaped with said wide connection section of said coil conductors being at the ends of said coil conductors.

18. A multilayer inductor according to claim 17, wherein said U-shaped coil connectors are positioned such that axes of symmetry of at least two of said coil conductors lie in a plane normal to the planes in which said coil conductors lie.

* * * * *